US005795237A

United States Patent [19]

Miyamoto

[11] Patent Number: 5,795,237

[45] Date of Patent: Aug. 18, 1998

[54] PORTABLE TYPE ELECTRONIC GOLF SCORE DISPLAY DEVICE

[75] Inventor: Yoshifumi Miyamoto, Tokyo, Japan

[73] Assignee: Sun Pionnier Co., Ltd., Tokyo, Japan

[21] Appl. No.: 698,687

[22] Filed: Sep. 4, 1996

Related U.S. Application Data

[63] Continuation of Ser. No. 245,037, May 17, 1994, abandoned.

[30] Foreign Application Priority Data

Sep. 3, 1993 [JP] Japan ..... 5-243614

[51] Int. Cl.[6] ..... A63F 9/24

[52] U.S. Cl. ..... 473/131; 473/409

[58] Field of Search ..... 463/1, 30–31, 463/36–37, 39, 40, 42–43; 473/131, 407, 409; 364/410, 411; 273/DIG. 26, DIG. 28

[56] References Cited

U.S. PATENT DOCUMENTS

| | | | |
|---|---|---|---|
| 3,805,411 | 4/1974 | Andrews, Jr. | 273/176 L |
| 4,655,451 | 4/1987 | Townsley | 273/32 H |
| 4,703,444 | 10/1987 | Storms, Jr. et al. | 273/32 H |
| 4,815,020 | 3/1989 | Cormier | 273/32 H |
| 4,910,677 | 3/1990 | Remedio et al. | 364/410 |
| 5,044,634 | 9/1991 | Dudley et al. | 273/32 R |
| 5,056,106 | 10/1991 | Wang et al. | 273/32 H |
| 5,095,430 | 3/1992 | Bonito et al. . | |
| 5,127,044 | 6/1992 | Bonito et al. . | |
| 5,284,340 | 2/1994 | Laakso | 273/32 H |
| 5,319,548 | 6/1994 | Germain | 273/32 R |
| 5,324,028 | 6/1994 | Luna | 273/32 R |
| 5,364,093 | 11/1994 | Huston et al. | 273/32 H |
| 5,434,789 | 7/1995 | Fraker et al. | 273/32 H |
| 5,438,518 | 8/1995 | Bianco et al. | 273/32 H |
| 5,469,175 | 11/1995 | Boman . | |

*Primary Examiner*—Jessica Harrison
*Assistant Examiner*—Mark A. Sager
*Attorney, Agent, or Firm*—Oblon, Spivak, McClelland, Maier & Neustadt, P.C.

[57] ABSTRACT

An electronic golf score display device including a display on which is displayed a required picture plane inputted through an input pen or an input pen and a keyboard; a memory in which predetermined processing procedures are stored; and a processing device interposed between the display and the memory to process the processing procedures, the processing procedures comprising (a) a picture plane processing for menu for setting a score card and selecting items of a score card to start a processing of a picture plane for the items, (b) a picture plane processing for score card setting for inputting a selection of a course, a selection of a yard and a score condition of a player to input these input informations into a score card memory, (c) a picture plane processing for a score card for displaying contents inputted in the picture plane for score card setting, inputting scores to automatically calculate and display a total and designating a course to execute a picture plane processing for course layout, and (d) a picture plane processing for course layout for displaying a course layout of a course designated on the score card picture plane on the picture plane, inputting a locus of strikes by an input pen and setting counts of scores of the course to a score card by the locus.

4 Claims, 35 Drawing Sheets

FIG. 5

XXXXXXFILE BEING READ

FIG. 7

LOCAL RULE

MENU

1. CORED PILES WITHIN THE COURSE INDICATE:
   WHITE PILE: OUT OF BOUND
   BLUE PILE OR WHITE LINE: UNDER REPAIR
   YELLOW PILE: WATER HAZARD

2. PROHIBIT USE OF CLUBS OTHER THAN A PATTER ON THE GREEN

3. DROP THE BALL ON THE STANDBY GREEN AT A POSITION OUTSIDE NEAREST THERET

4. FOR OTHERS, J. G. A. GAMES' RULES ARE APPLIED

5. REVISION OR ADDITION OF THE LOCAL RULE IS DISPLAYED IN A CLUB HOUSE, AND COMES INTO EFFECT ON THAT DAY

FIG. 8

| HOLE | 1 | 2 | 3 | 4 | 5 | 6 | 7 | 8 | 9 | | |
|---|---|---|---|---|---|---|---|---|---|---|---|
| YARD | 500 | 366 | 152 | 377 | 299 | 342 | 165 | 320 | 489 | | |
| PAR | 5 | 4 | 3 | 4 | 4 | 4 | 3 | 4 | 5 | | |
| HDCP | 3 | 4 | 5 | 1 | 7 | 9 | 8 | 2 | 6 | OUT | SCORE |
| | | | | | | | | | | | |
| | | | | | | | | | | | |
| | | | | | | | | | | | |
| | | | | | | | | | | | |

MENU

TOTAL

FIG. 11

INDIVIDUAL EVALUATION

MENU

DATE OF PLAY : X X, 19XX

| | | | | |
|---|---|---|---|---|
| WEATHER : | 1. FINE | 2. CLOUDY | 3. RAIN | 4. SNOW |
| WIND : | 1. NO | 2. WEAK | 3. STRONG | |
| PHYSICAL CONDITION : | 1. GOOD | 2. NORMAL | 3. BAD | |
| SYNTHESIS : | 1. A | 2. B | 3. C | |

FIG. 13

SCORE CARD BEING PRINTED

FIG. 14

XXXXXX FILE BEING WRITTEN

PORTABLE TYPE ELECTRONIC GOLF SCORE DISPLAY DEVICE

This application is a Continuation of application Ser. No. 08/245,037, filed on May 17, 1994, now abandoned.

FIELD OF THE INVENTION

This invention relates to a electronic golf score display device, which has a function of an electronic computer and display scores of a golf, and more particularly to a portable type electronic golf score display device while being carried.

DESCRIPTION OF THE PRIOR ART

In a golf contest, a score card on which scores thereof are recorded has been used. At present, however, it is usual that each player writes scores in a printed score card by writing material such as a pencil.

According to the above conventional method, an entry of scores is made after each hole out. Therefore, an error in calculation tends to occur in calculating scores every strike. Further, it is almost impossible to record the state of each strike (for example, OB or 1 pena.).

Moreover, in the existing circumstances, a device to display a residual yard of strike in each course has not yet been developed. Such a matter merely depends on information from a caddie or on a player's own judgement. This comprises a bottleneck of a golf contest in view of the difficulty of such judgement.

SUMMARY OF THE INVENTION

The electronic golf score display device according to the present invention includes:

a display on which is displayed a required picture plane inputted through an input pen or an input pen and a keyboard; a memory in which predetermined processing procedures are stored; and a processing device interposed between said display and said memory to process said processing procedures, said processing procedures comprising (a) a picture plane processing for menu for setting a score card and selecting items of a score card to start a processing of a picture plane for the items, (b) a picture plane processing for score card setting for inputting a selection of a course, a selection of a yard and a score condition of a player to input these input informations into a score card memory, (c) a picture plane processing for a score card for displaying contents inputted in said picture plane for score card setting, inputting scores to automatically calculate and display a total and designating a course to execute a picture plane processing for course layout, and (d) a picture plane processing for course layout for displaying a course layout of a course designated on said score card picture plane on the picture plane, inputting a locus of strikes by an input pen and setting counts of scores of said course to a score card by said locus.

In the above-described construction, the construction from which (a) a picture plane processing for deleting a menu is included as part of the present invention. In the (d) a picture plane processing for course layout, the residual distance of strikes is displayed on the picture plane. Further, in the (d) a picture plane processing for course layout, a processing procedure for updating scores corresponding to the various states of strikes is incorporated.

With the above-described construction, the electronic golf score display device operates as follows:

The processing for items is started by instructions of items on the menu picture plane so that required information is inputted on the score card setting picture plane, after which scores and a course layout are displayed on the input/output picture plane. The locus of the strike by an input pen in the course layout is inputted and scores of the score card are automatically calculated and updated in accordance with the locus information. The scores are displayed at any time, and the locus of strikes in the course layout is also displayed.

In the display of the course layout, the residual distance of strikes is also displayed together with the locus of strikes.

Further, in the display of the course layout, the scores are updated according to the various strike states.

According to the electronic golf score display device of the present invention, the scores and a course layout are displayed anytime it is required on the input/output picture plane with the locus of the strikes being displayed on the course layout and the present scores being updated automatically in accordance with the locus information. Thus, a player can use it with pleasure in a game sense. The device can be very easily used due to its small type.

Furthermore, according to the present device, the processing by way of electronics is executed so that the preservation of recorded information and the application to the concentrated management can be easily attained, thus providing a great convenience.

BRIEF DESCRIPTION OF THE DRAWINGS

FIG. 5 is a view showing a structural example of a file read picture plane;

FIG. 7 is a view showing a structural example of a local rule display picture plane;

FIG. 8 is a view showing a structural example of a score card picture plane;

FIG. 11 is a view showing a structural example of an individual evaluation picture plane;

FIG. 13 is a view showing a structural example of a score card printing picture plane;

FIG. 14 is a view of a structural example of a file write picture plane;

DETAILED DESCRIPTION OF THE PREFERRED EMBODIMENTS

An embodiment of an electronic golf score display device according to the present invention will be described hereinbelow with reference to the accompanying drawings.

Figure 1:
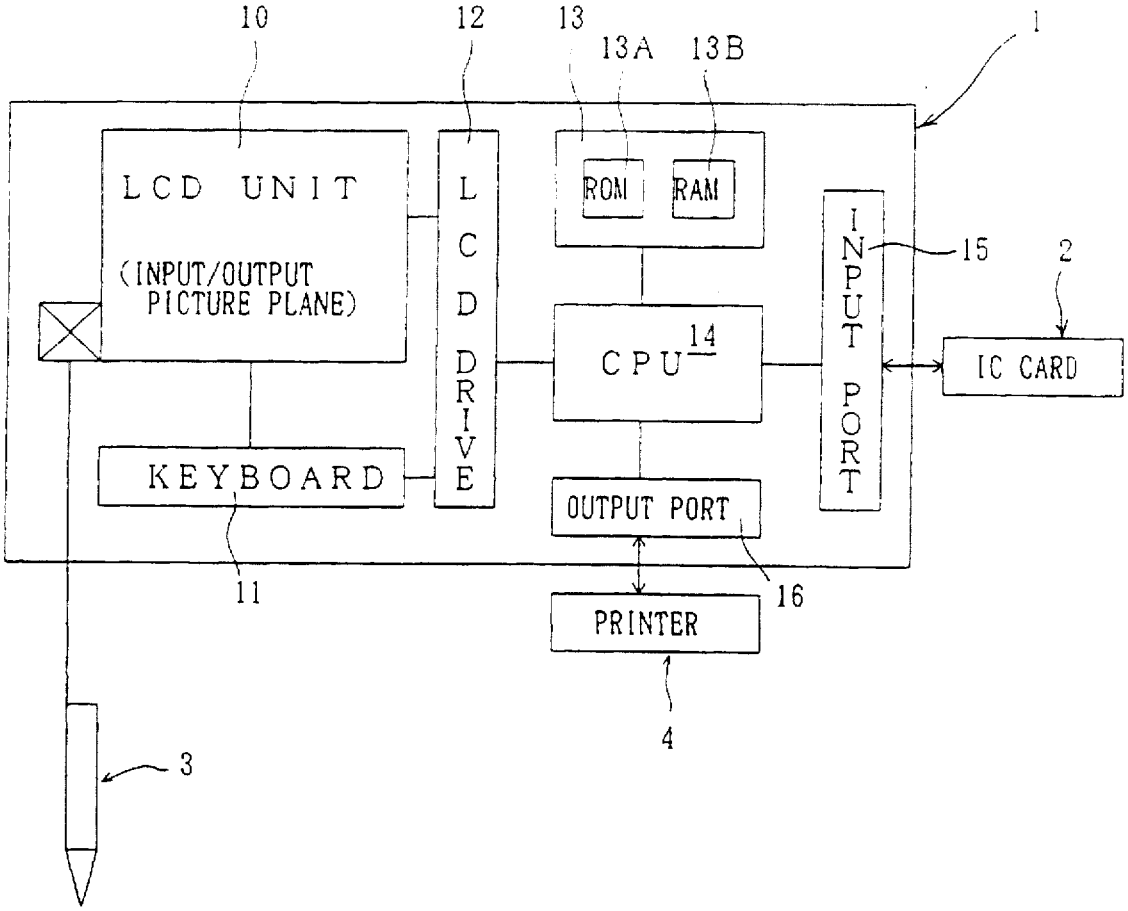
FIG. 1 is a whole structural view of a system of an electronic golf score display device according to the present invention.
Figure 2:
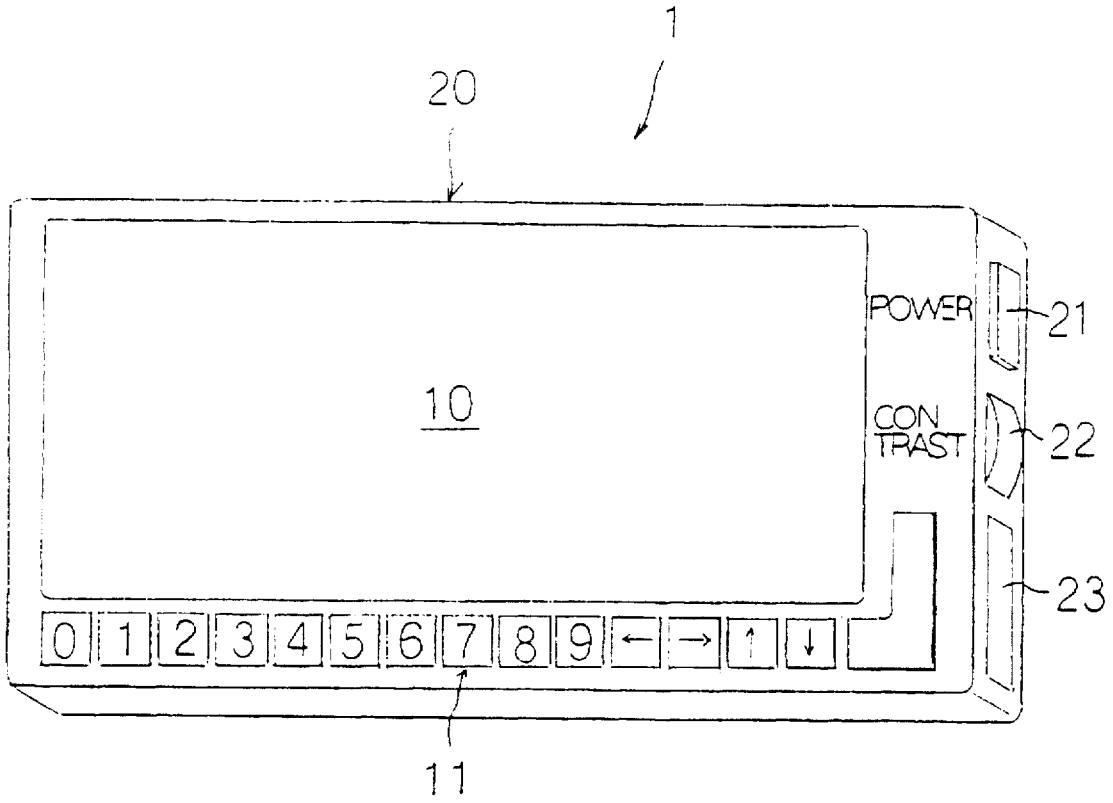
FIG. 2 is an external structural view of a display of the present device.

FIGS. 1 to 35 show one embodiment of the present device. That is, FIG. 1 shows the whole structure of a system of the electronic golf score display device; FIG. 2 shows one example of the external structure of the device; FIGS. 3 to 14 show the developed structure of a display picture plane displayed on the display device; and FIGS. 15 to 35 respectively show flowcharts of a program incorporated in the display device.

The structure of the whole system of the electronic golf score display device will be described with reference to FIG. 1.

In FIG. 1, reference numeral 1 designates a display; 2 an IC card; 3 an input pen, and 4 a printer. These are independent devices and parts. The input pen 3 is integral with the display 1. The IC card 2 can be suitably omitted. The printer 4 is not included in the present device in a narrow sense.

The display 1 is composed of an LCD unit 10 having an input/output display picture plane, a keyboard 11 as an input device, an LCD drive 12, a memory 13 including ROM and RAM, a CPU (Central Processing Unit) 14, an input port 15, and an output port 16. Signals are exchanged between these elements through buses.

FIG. 2 shows one example of the external structure of the display 1. In a portable size case 20, a display picture plane of the LCD unit 10 and the keyboard 11 are arranged on the surface of the case, and other elements such as a power supply button 21, a luminance adjusting dial 22, and an IC card insertion hole 23 are arranged.

This display 1 is of a sm all type, which can be carried.

Various components of the display 1 will be described below.

LCD unit 10

The LCD unit 10 mainly has a display function as a liquid crystal display, and also has an input function connected to the keyboard 11 and the input pen 3. The LCD unit 10 is preferably of a color display but white/black display is not excluded. It is to be noted that a mask is suitably applied to a display picture plane so that there can be provided with a function such that an input by way of the input pen 3 is executed only in the mask region.

Keyboard 11

The keyboard 11 consists of integer key buttons 0 to 9, a feed key button and an execution button. The keyboard 11 is operatively connected to the LCD unit 10 so that the keyboard is pressed in response to the input instruction displayed on the LCD unit 10 to execute a command. The keyboard 11 can be omitted as the case may be.

LCD drive 12

The LCD drive 12, operatively connected to the LCD unit 10. The keyboard 11 the memory 13 and the CPU 14, exchanges information between the input/output in the input/output picture plane of the LCD unit 10 and the CPU 14.

Memory 13

The memory 13 includes a ROM 13A and a RAM 13B. The ROM 13A stores a program for executing a desired operation for the present electronic golf score display device. The RAM 13 includes a V-RAM.

CPU 14

CPU, i.e. the central processing unit 14 controls the exchange of internal information with the LCD unit 10 through the memory 13 and is operatively connected to the input port 15 and the output port 16 to control the exchange of information with the exterior.

Input port 15

The input port 15 is operatively connected to the CPU 14 to input information from the IC card 2 as an interface and write information to the IC card 2.

Output port 16

The output port 16 is operatively connected to the CPU 14 to comprise an output to the printer 4 as an interface.

Next, the IC card 2, the input pen 3 and the printer 4 will be explained briefly.

IC card 2

The IC card 2 encases a RAM as a semiconductor element to receive predetermined information of the golf links. That is, a local rule as main information and other informations such as a score and a course layout are received therein. The IC card 2 is inserted into the IC card insertion hole 23 of the display 1, as previously mentioned, to provide input and output of information through the input port 15. It is to be noted that CPU and or a flush ROM can be added to the IC card 2.

Input pen 3

The input pen 3 is operatively connected to the LCD unit 10 as a cordless and gives a position input and a write down letter input to the LCD unit 10. The LCD unit 10 has a letter recognition function with respect to the write down input.

Printer 4

The printer 4 is separate from the display 1. The printer 4 is connected to the output port 16 of the display 1 to print out information within the memory 13, that is, a score card, a total score and a course layout in response to a command (specifically, a "score card print" command in the menu picture plane described later) of the CPU 14. Normally, one printer will suffice.

While in the present embodiment, the printer 4 is connected to the output port 16 of the display 1 for use, it is to be noted that a mode capable of providing a remote control by way of wireless may be employed.

The system shown in FIG. 1 and the structure of the display 1 shown in FIG. 2 merely illustrate one example, and other suitable structures for carrying out the present invention can be also employed.

That is, the keyboard 11 as the input device can be omitted, and the input pen 3 can be used instead of the keyboard. Further, a touch input function can be added. The IC card 2 can be omitted, then all information can be handled by the memory 13 within the display 1.

On the basis of the structure of the present electronic golf score display device as described above, the operation featured in the present invention will be performed, as well as the peripheral devices 2, 3 and 4, in accordance with a program stored in the memory 13.

That is, FIGS. 3 to 14 show display examples of the input/output picture plane of the display 1. FIGS. 15 to 35 show the flowcharts of programs.

Figure 3:
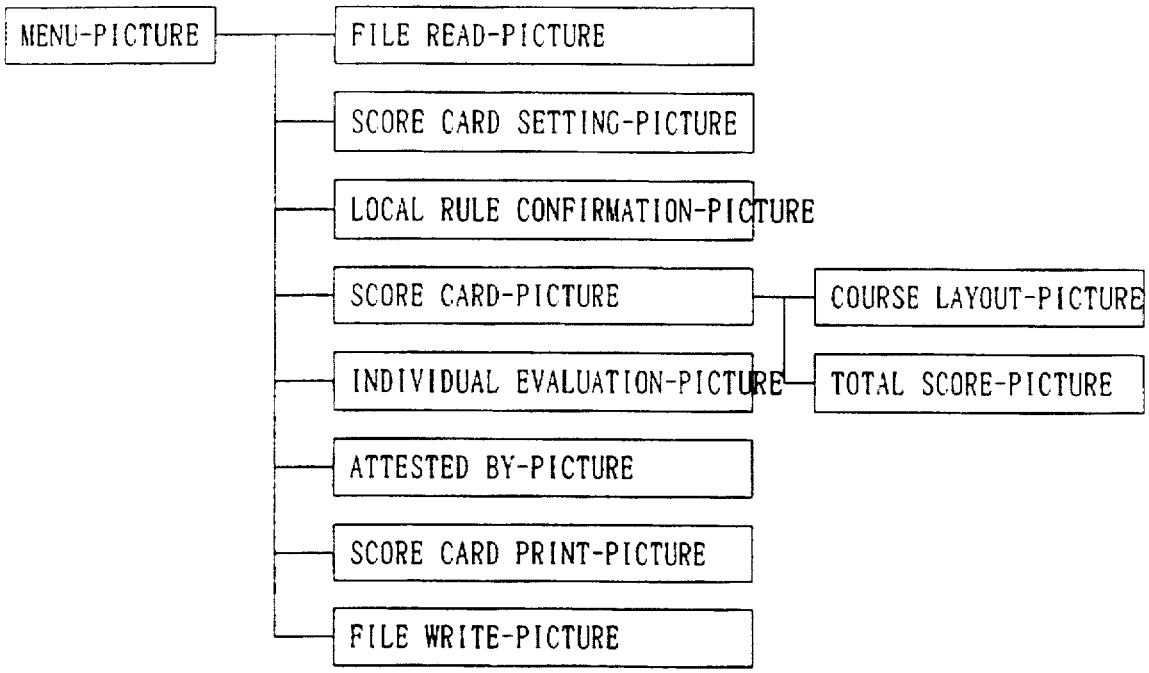
FIG. 3 is a relative structural view of each display picture plane.

Out of these drawings, FIG. 3 shows the relative structure of the display picture planes of FIGS. 4 to 14, and FIG. 15 shows the outline of the processing procedure.

Figure 15:
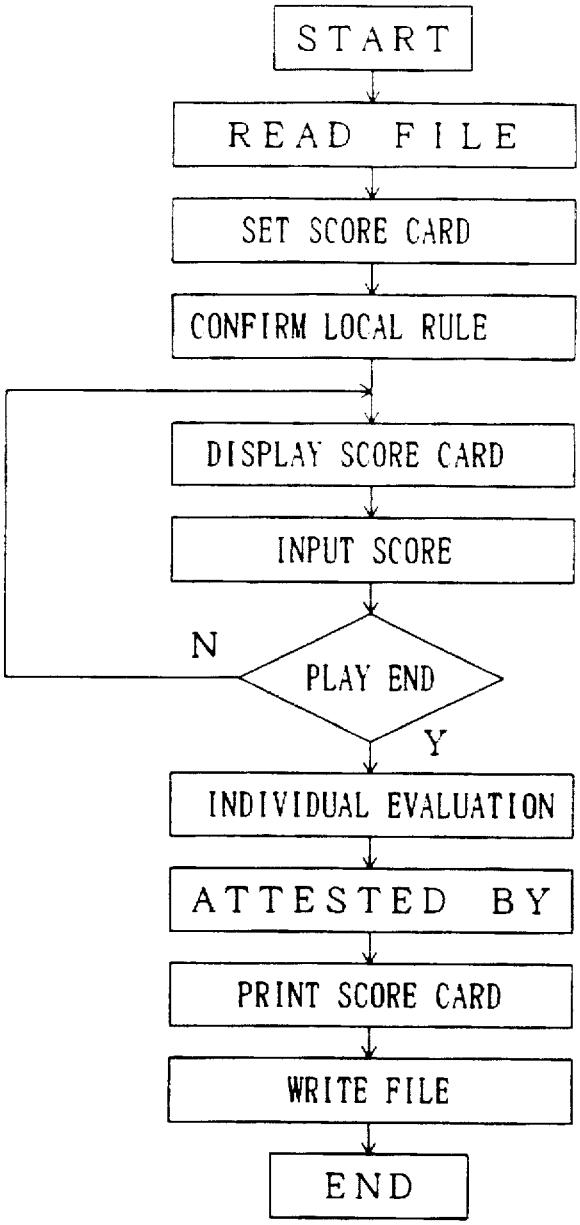
FIG. 15 is a flowchart showing the outline of a processing procedure.

The relative structure of the display picture planes and the outline of the processing procedure will now be described with reference to FIGS. 3 and 15.

Menu picture plane

Items of a file read, a score card setting, a local rule confirmation, a score card, an individual evaluation, an ATTESTED BY, a score card printing, and a file write are selected to start the processing of various picture planes.

File read picture plane

A local rule file, a score file, and a course layout of the IC card are written into the file of the body.

Score card setting picture plane

A selection of courses (such as IN, OUT), a selection of yards (such as BACK, REG, LADY'S), a player's name, and a handicap are inputted so that input information is set to the score card.

Local rule confirmation picture plane

A local rule file is read to display it on the picture plane.

Score card picture plane

Contents (yard, hole and player) inputted in the score card setting picture plane are displayed. Scores (of the principal and a partner) are automatically calculated by inputting figures on the keyboard and the total thereof is displayed. The score of the principal is automatically displayed by inputting the locus of strikes on the course layout picture plane but the keyboard input can be also used. The processing of the course layout picture plane is executed by designating the course layout display and the hole. The total score picture plane is displayed by designating the total score.

Course layout picture plane

A course layout picture plane of a hole designated on the score card picture plane is displayed. The locus of a ball striked by a player himself can be inputted. A count of scores is set to a score card by inputting the locus of strikes.

Total picture plane

The total picture plane is operatively connected to the score card picture plane to display a total score of each player.

Individual evaluation picture plane

An evaluation of plays for that day is inputted. Items to be inputted include date, weather, the direction of the wind, physical condition and synthetic evaluation of scores (A, B, C).

ATTESTED BY picture plane

An entry of ATTESTED BY is made.

Score card printing picture plane

Score cards (including a total score) and evaluation are printed and also a course layout (results) are printed out.

File write picture plane

A score file, an evaluation file and a course layout (results) which are present in the body are written into the IC card 2.

The operation of the portable electronic golf score display will be described below on the basis of the flowcharts shown in FIGS. 16 to 35.

(Main processing) (Menu picture plane)

Figure 16:
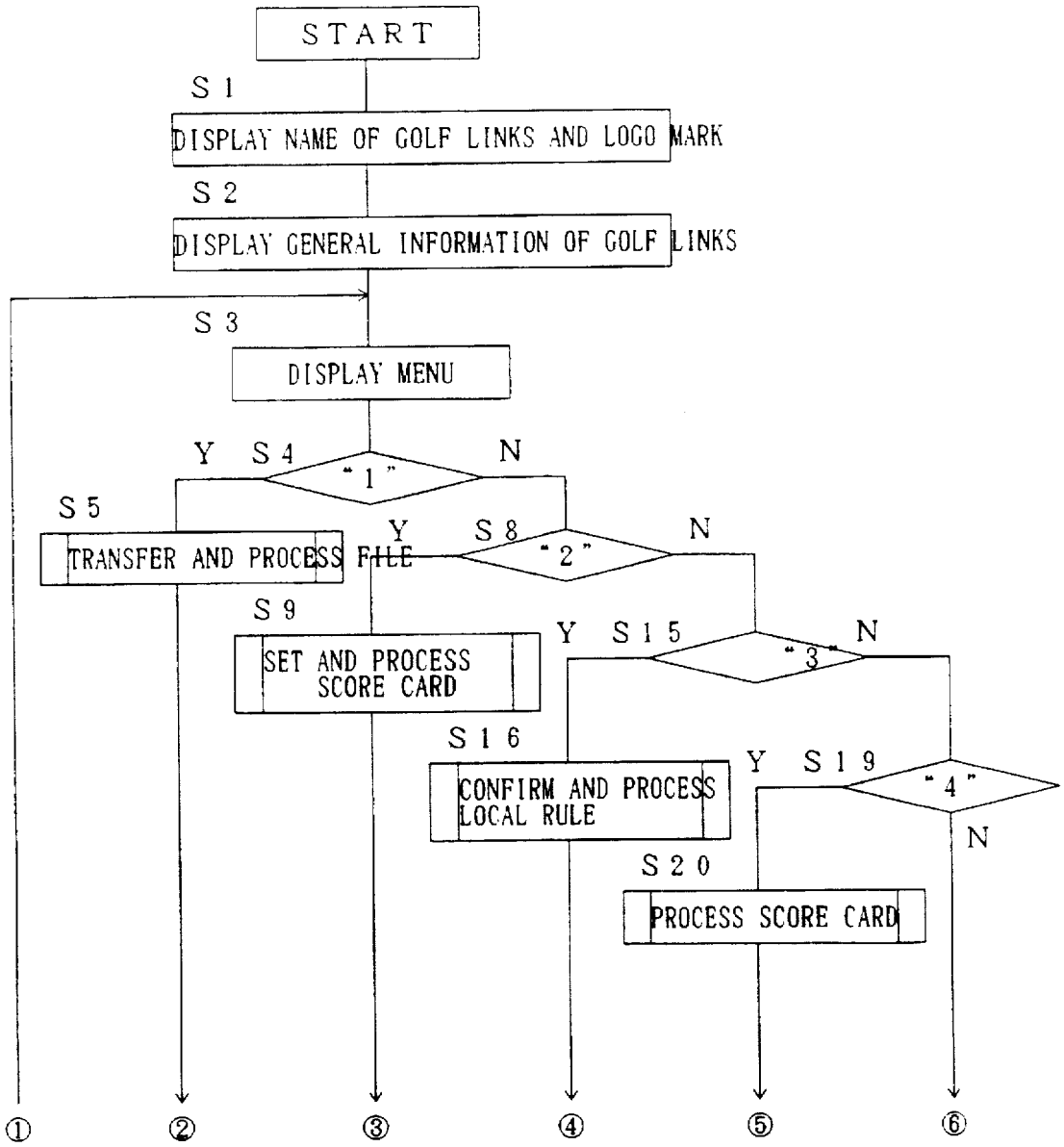
FIG. 16 is a flowchart of a main processing.
Figure 17:
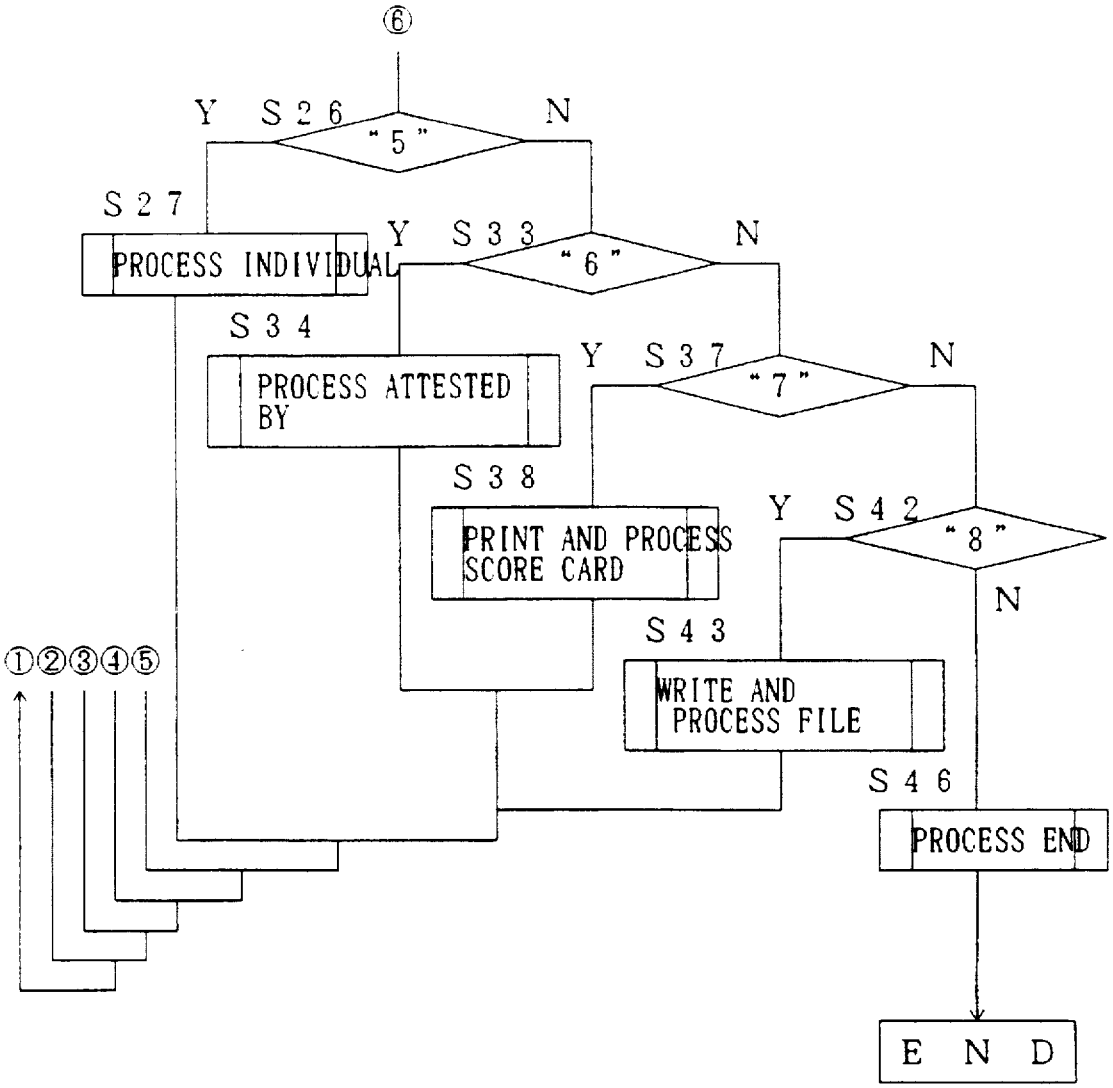
FIG. 17 is a flowchart of a main processing.

FIGS. 16 and 17 show flowcharts for the main processing.

When a power supply is turned ON, a name of golf links and a logo mark thereof are displayed on the picture plane (Step S1). That is, these informations are read from the IC card 2 to be displayed on the picture plane. Then, an explanation of the outline of the course in the golf links is displayed on the picture plane (Step S2). That is, information of the explanation of the outline of the course in the golf links is read from the IC card 2 to be displayed on the picture plane. The menu picture plane is displayed (Step S3).

Figure 4:
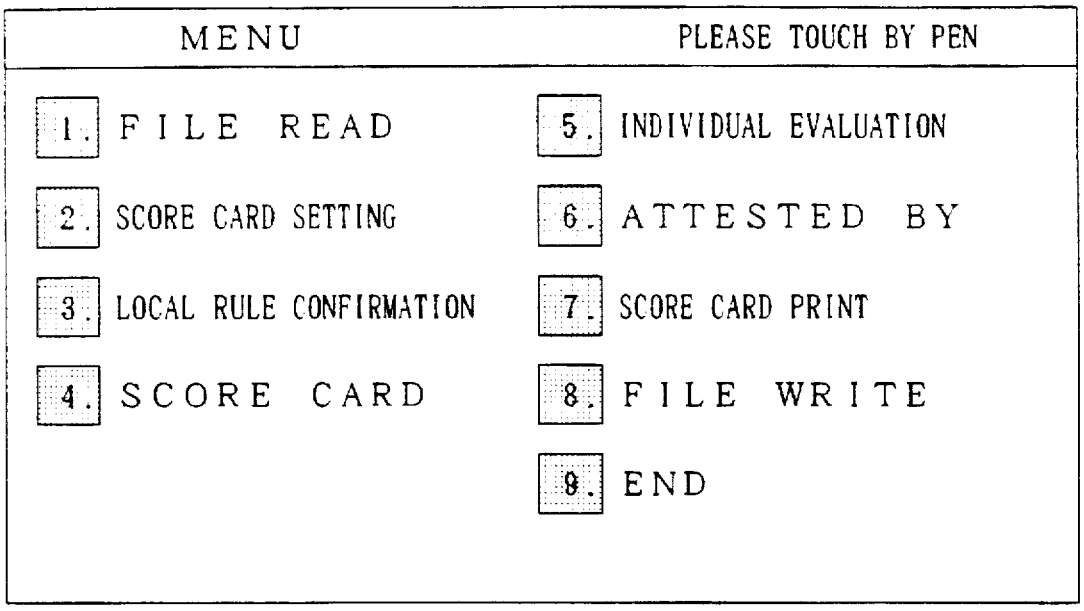
FIG. 4 is a view showing a structural example of a menu picture plane.

FIG. 4 shows a display example of the menu picture plane. In this menu picture plane, a predetermined frame is prepared for items 1 to 9. The input pen 3 is placed in contact with the frame to display the desired picture plane of items 1 to 8 or to shift to an end processing.

The processing procedure will be described in order of items 1 to 9.

(File read)

When "File read" of "1." in the menu picture plane (FIG. 4) is instructed by the input pen 3, "1" in Step S4 is determined. Then a sub-routine of a file transfer processing in Step S5 is executed.

Figure 18:
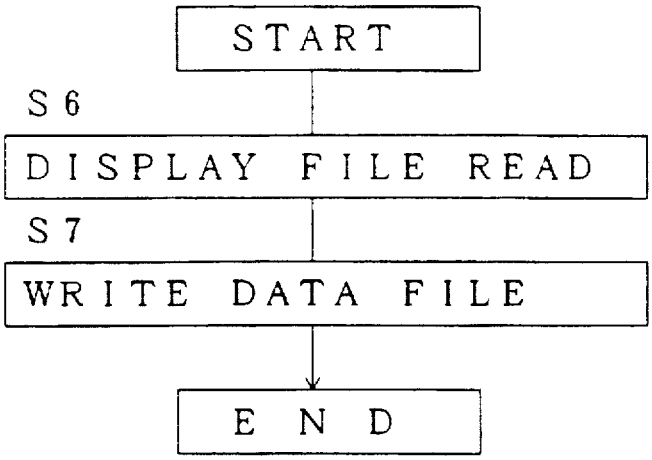
FIG. 18 is a flowchart of a file transfer processing.

FIG. 18 shows a flowchart of a sub-routine of the file transfer processing. In Step 6, a file read picture plane is displayed.

FIG. 5 shows a display example of the file read picture plane.

In Step S7, a data file is read from the IC card 2 to be stored once in the memory 13 within the display 1. After completion of Step S7, the menu picture plane of Step S3 is again displayed.

(Score card setting)

When "Score card setting" of "2." in the menu picture plane (FIG. 4) is instructed by the input pen 3, the procedure shifts to Step S8, then a sub-routine of the score card setting processing of Step S9 is executed.

Figure 19:
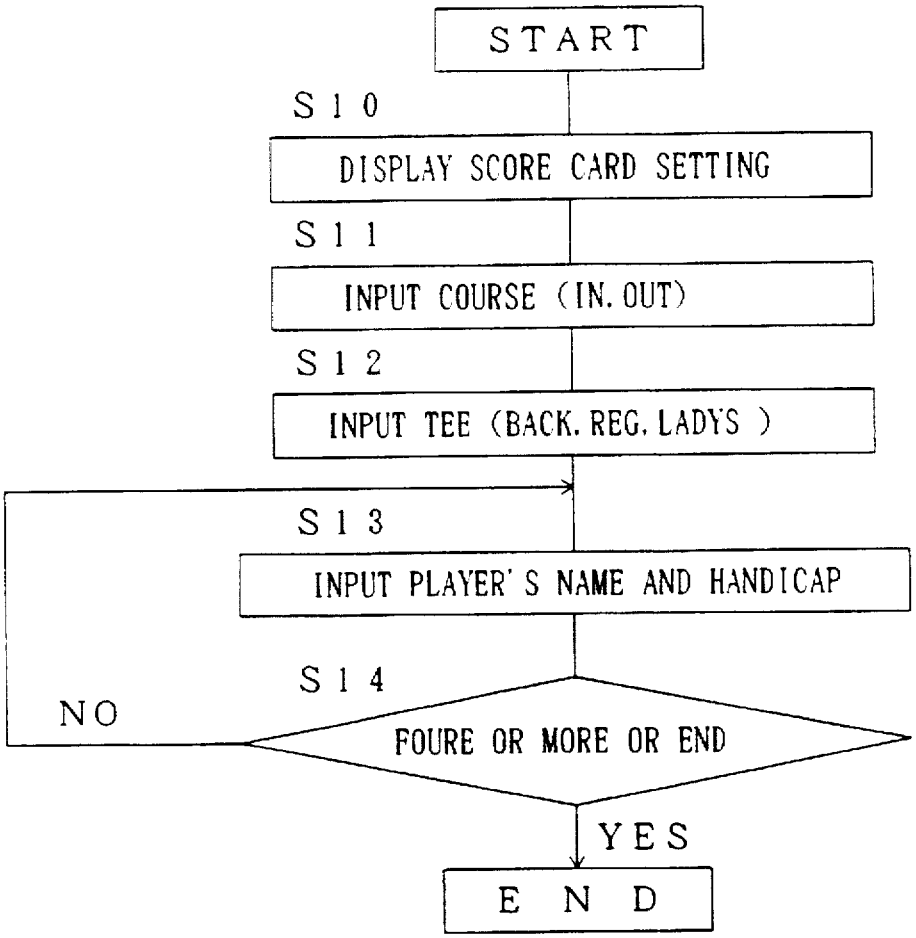
FIG. 19 is a flowchart of a score card setting procedure.

FIG. 19 shows a flowchart of a sub-routine of the score card setting processing. In Step S10, the score card setting picture plane is displayed.

Figure 6:
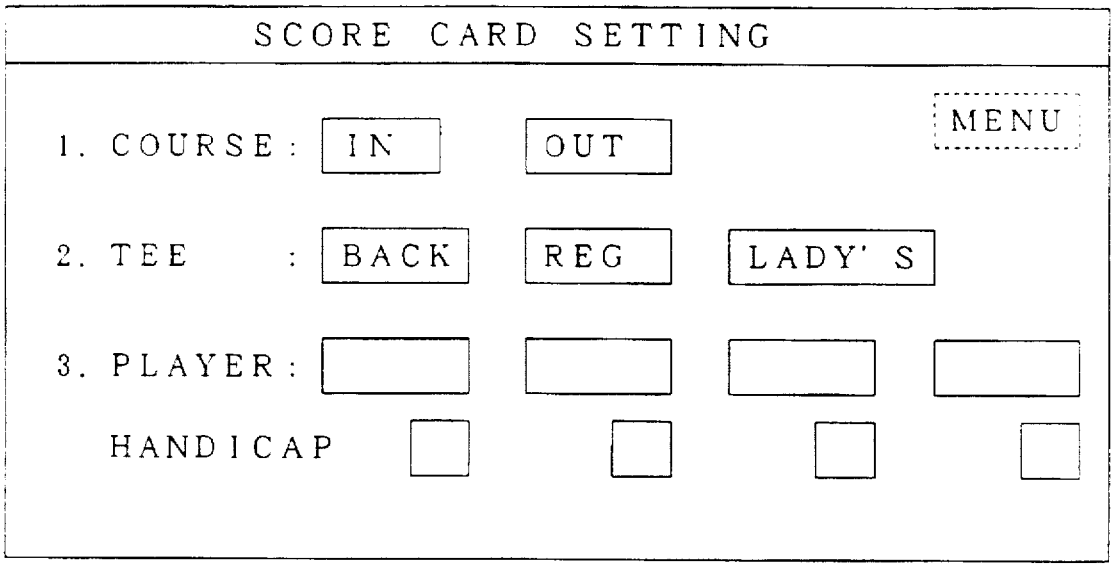
FIG. 6 is a view showing a structural example of a score card setting picture plane.

FIG. 6 shows a display example of the score card setting picture plane.

In Step S11, the input instruction of "IN" or "OUT" of the course is made by the input pen 3. Next, in Step S12, the input instruction of either "BACK", "REG", or "LADY'S" of TEE is inputted by the input pen 3. Further, in Step S13, a player's name and a handicap are inputted by the input pen 3 and figure buttons. For the input of a player's name, an entry region having a predetermined width is displayed, and a name in a written form is entered into the region by the input pen 3. In the existing circumstances, the written form is displayed but a mechanism for changing it into a type by a dictionary file can be employed as the case may be.

In Step S14, inputs of names of four players and their handicaps are determined. If NO, the procedure returns to Step S13. When the names of four players and the handicaps have been inputted, YES is determined in Step S14, then, the menu picture plane of Step S3 is again displayed.

It is to be noted that when "Menu" is instructed by the input pen 3 during the inputting on the score card setting picture plane (FIG. 6), the picture plane again returns to the menu picture plane of Step S3.

(Local rule confirmation processing)

When "Local rule confirmation" of "3" on the menu picture plane (FIG. 4) is instructed by the input pen 3, the procedure shifts to Step S15, then a sub-routine of the local rule confirmation processing in Step S16 is executed.

Figure 20:
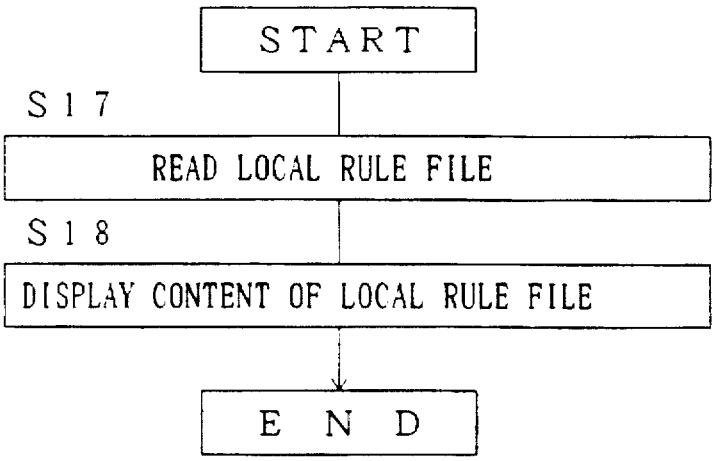
FIG. 20 is a flowchart of a local rule confirmation processing.

FIG. 20 shows a flowchart of a sub-routine of the local rule confirmation processing. In Step S17, a local rule file is read from the IC card 2, and the content of this file is displayed on the picture plane (Step S18).

FIG. 7 shows a display example of the local rule picture plane.

In this picture plane, when "Menu" is instructed by the input pen 3, the menu picture plane of Step S3 is again displayed. In this picture plane, after passage of predetermined time, the processing to return to Step S3 can be taken.

(Score card processing)

When "Score card" of "4" on the menu picture plane (FIG. 4) is instructed by the input pen 3, the procedure shifts to Step S19, then a sub-routine of a score card processing of Step S20 is executed.

Figure 21:
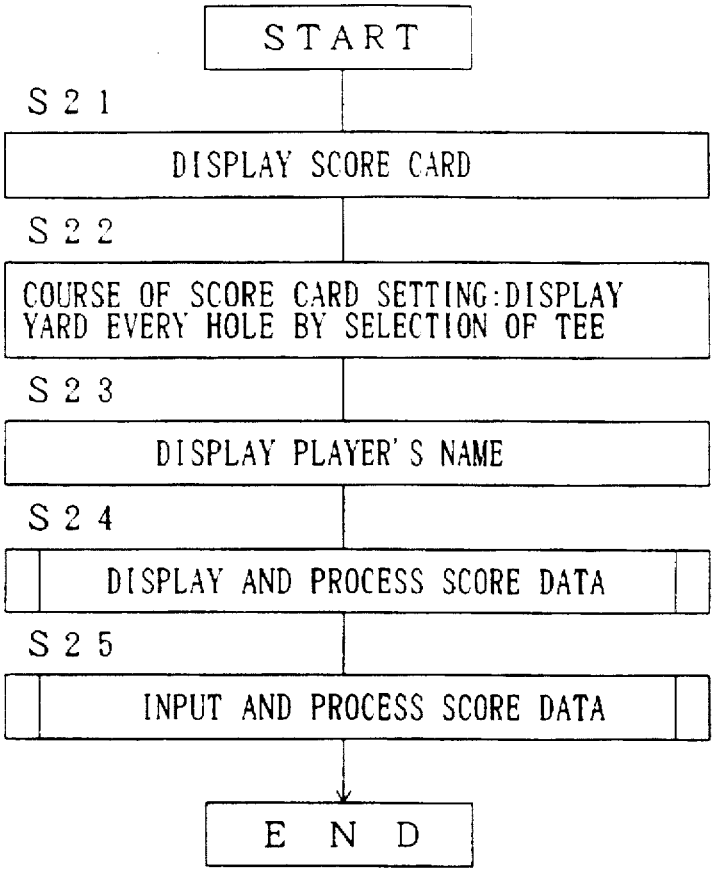
FIG. 21 is a flowchart of a score card processing.

FIG. 21 shows a flowchart of a sub-routine of the score card processing. In Step S21, a score card picture plane is displayed.

FIG. 8 shows a display example of the score card picture plane.

In Step S22, by selection of course and TEE of the score card setting picture plane (see FIG. 6), YARD, PAR and HDCP of every hole are displayed. In Step S23, a player's name is displayed by the input of a player of the score card setting picture plane (see FIG. 6). Accordingly, unless the course, Tee and a player's name are inputted, these items are not displayed on the score card picture plane shown in FIG. 8.

Next, in Step S24, a score data display processing is carried out. The score data display processing is executed as a sub-routine. In Step S25, a score data input processing is carried out. The score data input processing is executed as a sub-routine.

The sub-routines of the score data display processing and the score data input processing will be described with reference to FIGS. 22 to 31.

Figure 22:
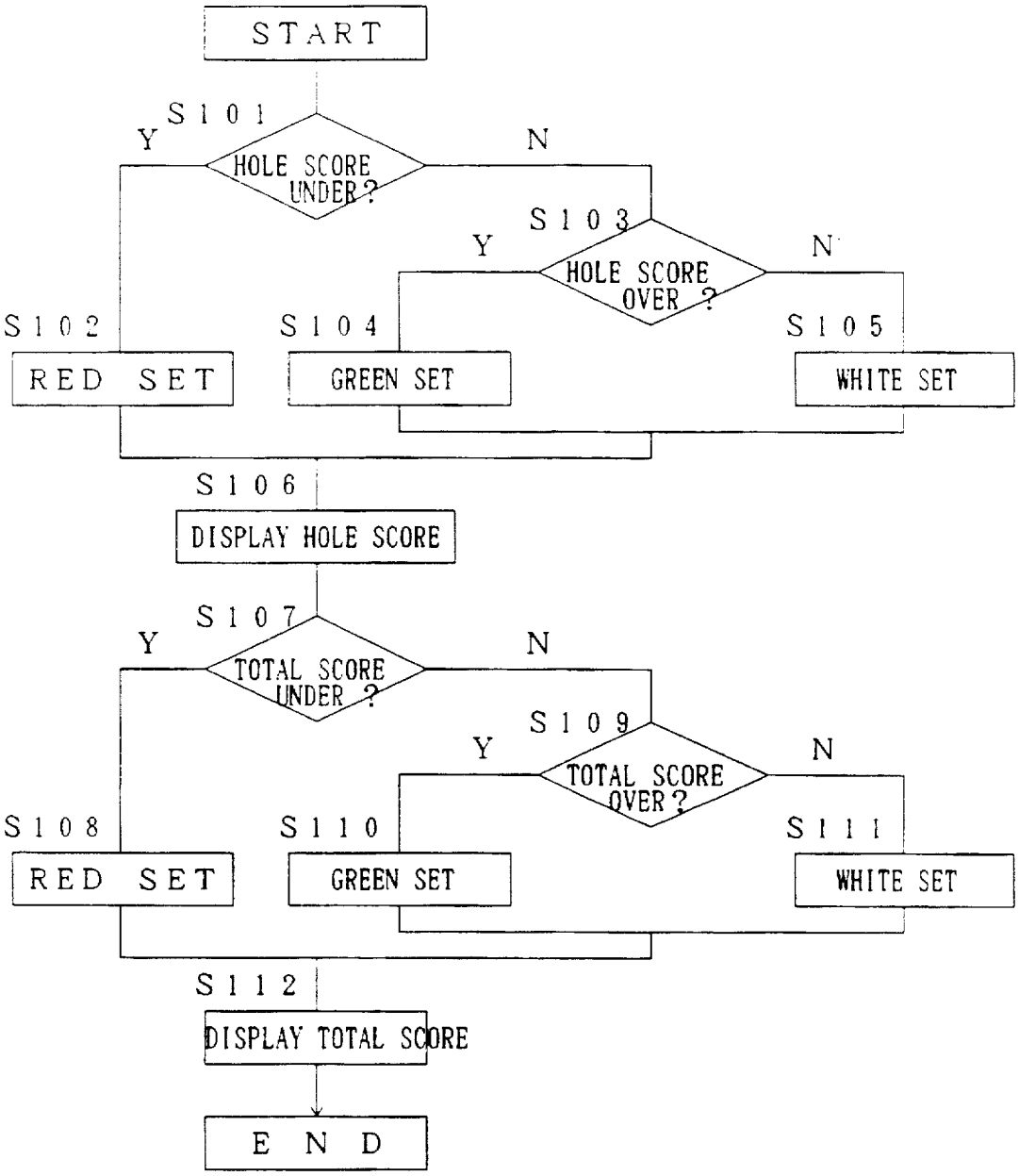
FIG. 22 is a flowchart of a score data display processing.

That is, the score data display processing is shown in FIG. 22, and the score data input processing is shown in FIGS. 23 to 31.

(Score data display processing)

FIG. 22 shows a sub-routine of the score data display processing.

A hole column of the score card (FIG. 8) is updated in the following Steps.

In Step S101 when, the hole is completed, it is determined whether a hole score in that hole is under or not. If it is under, the hole column of the score card is set to red (Step S102). (Thereafter, the procedure proceeds to Step S106). In Step S101, if it is not under, the procedure proceeds to Step S103, where it is determined whether a score in that hole is over or not. If it is over, the hole column of the score card is set to green (Step S104). If it is not over, the hole column is set to white (Step S105).

The procedure proceeds to Step S106 from Steps S102, S104 and S105, where in that hole column, a score of the hole is displayed.

Next, the procedure proceeds to Step S107, where it is determined whether a total score is under or not. If it is under, the total score column is set to red (Step S108). (Thereafter, the procedure proceeds to Step S112).

In Step S107, if it is not under, the procedure proceeds to Step S109, where it is determined whether a total score is over or not. If it is over, a total score column is set to green (Step S110). If it is not over, a total column is set to white (Step S111). The procedure proceeds to Step S112 from Steps S108, S110 and S111, where a total score is displayed on the total score column, and the present sub-routine is completed.

(Score data input processing)

In this sub-routine, a sub-routine of a course layout picture plane processing is included. A layout of the course concerned is displyed on the picture plane, and a coordinate computation of strikes is carried out by an image processing function, and the score proceeds with a game property.

Figure 23:
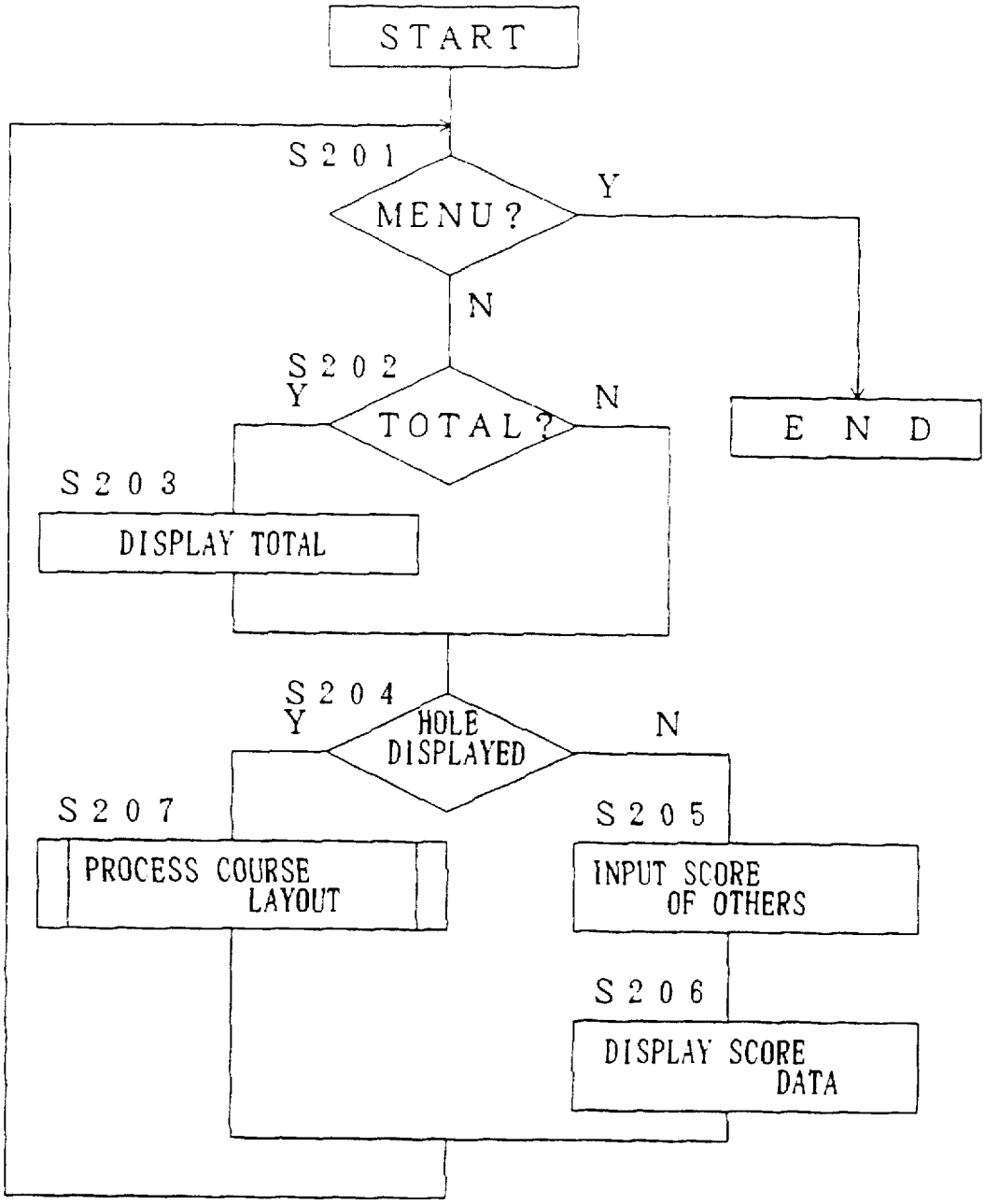
FIG. 23 is a flowchart of a score data input processing.

In FIG. 23 in step S201, it is determined, whether a menu is or not. If it is menu, the sub-routine is completed. If it is not menu, the procedure proceeds to Step S202, where it is determined whether a total is or not. If it is total, a total score picture plane is displayed (Step S203).

Figure 10:
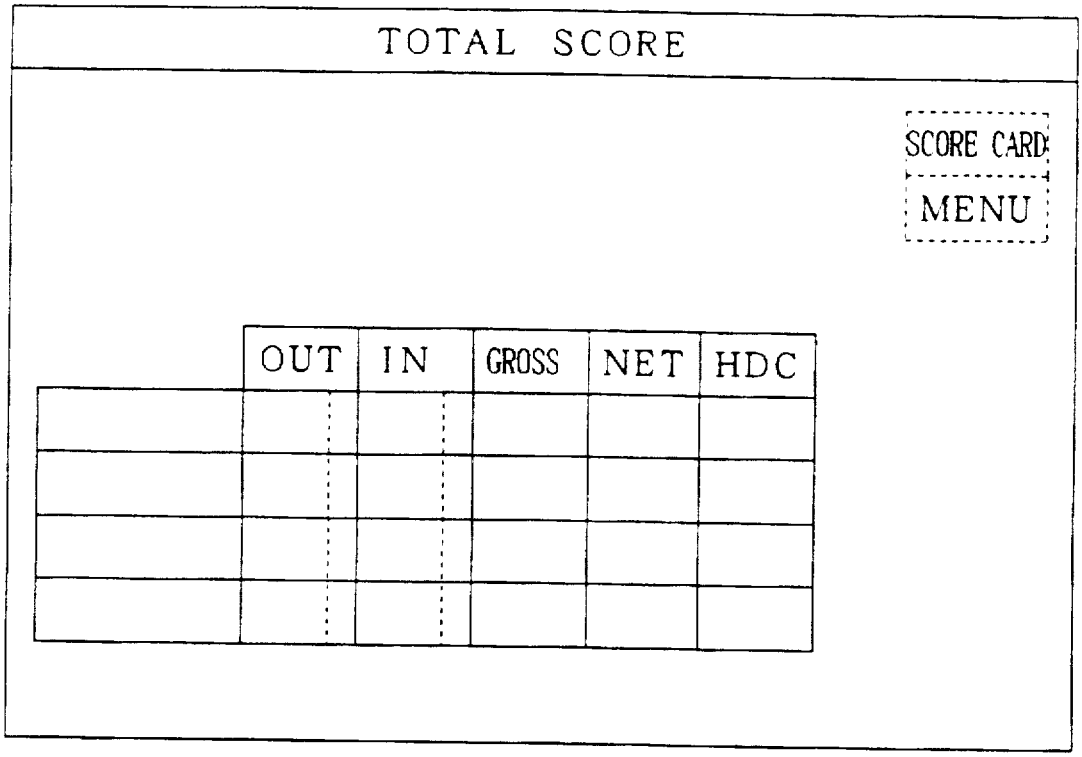
FIG. 10 is a view showing a structural example of a total score picture plane.

FIG. 10 shows one example of the total score picture plane. An input indication column for a menu and a total is provided.

In Step S203, a total pi ctu re plan e is displayed or in Step S202, if not total, the procedure proceeds to Step S204, where it is determined whether a display of hole is or not. If it is not a display of hole, a score of the other player is inputted (Step S205). A score data is displayed (Step S206). The procedure returns to Step S201.

In Step if it is, a display of hole, the procedure proceeds to Step S207, where a course layout picture plane processing is carried out.

(Course layout picture plane processing)

Figure 24:
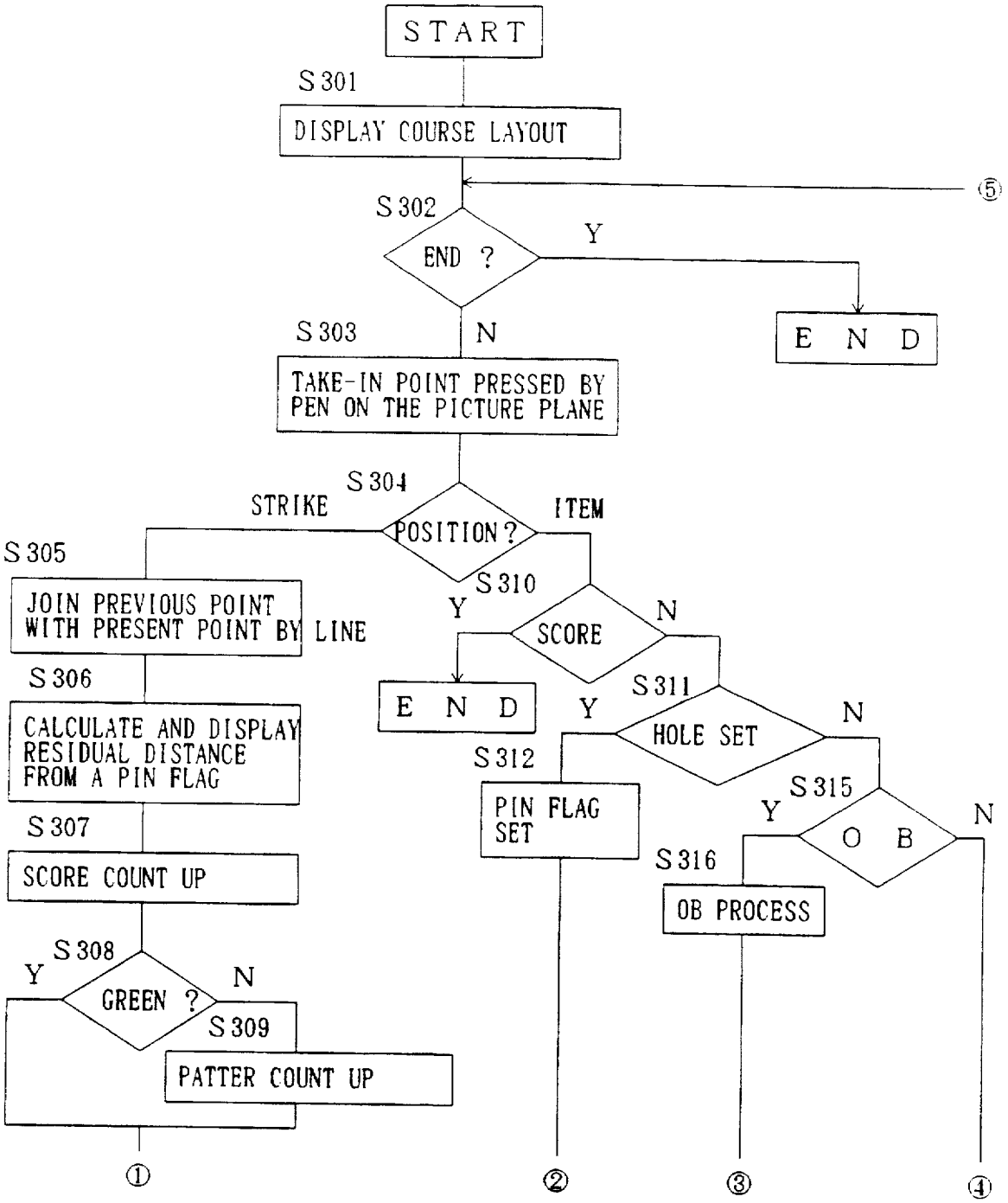
FIG. 24 is a flowchart of a course layout picture plane.
Figure 25:
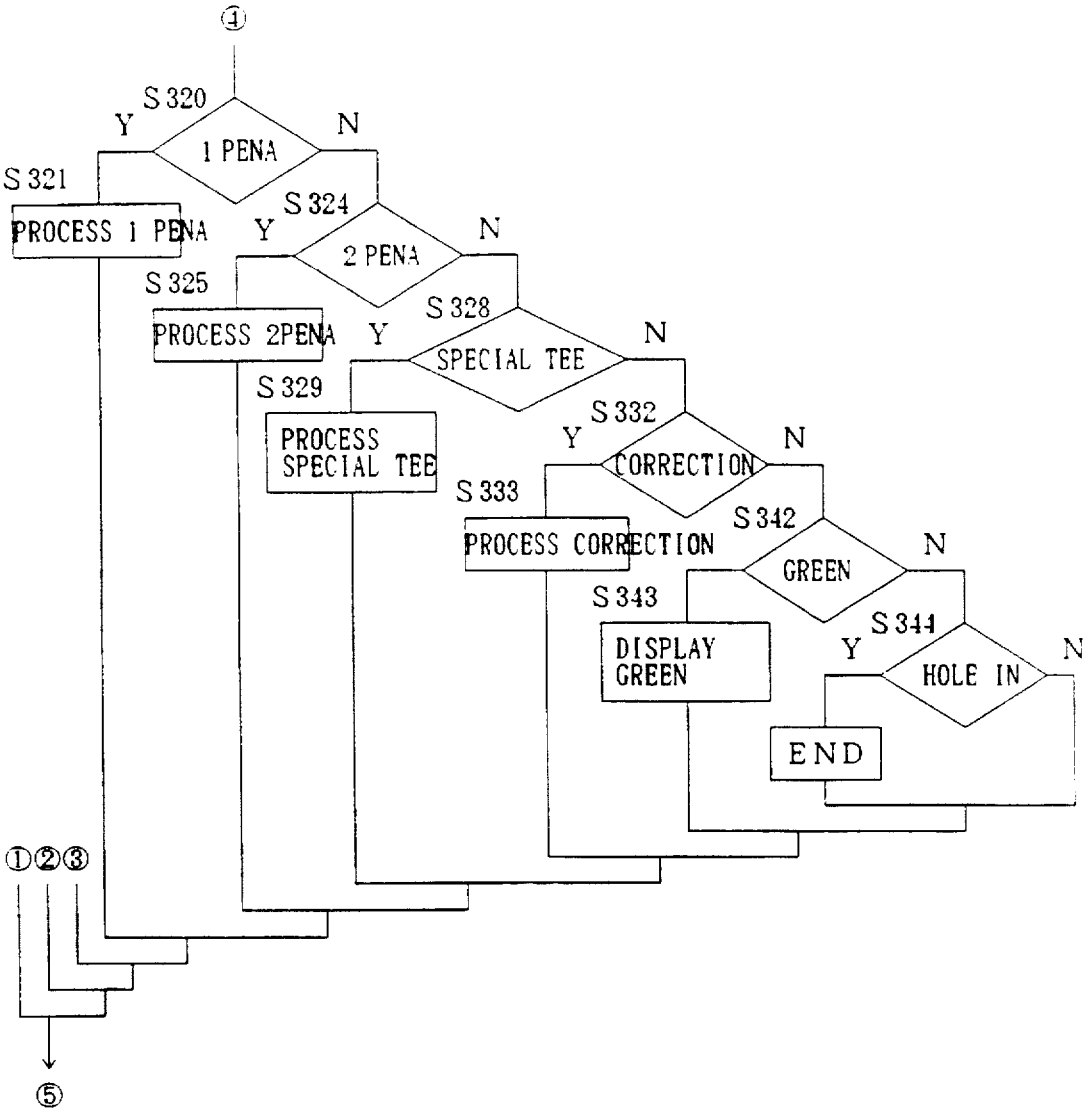
FIG. 25 is a flowchart of a course layout picture plane.

FIGS. 24 and 25 show a sub-routine of a course layout picture plane processing.

Referring to FIGS. 24 and 25, a picture plane of a course layout is first displayed (Step S301).

Figure 9:
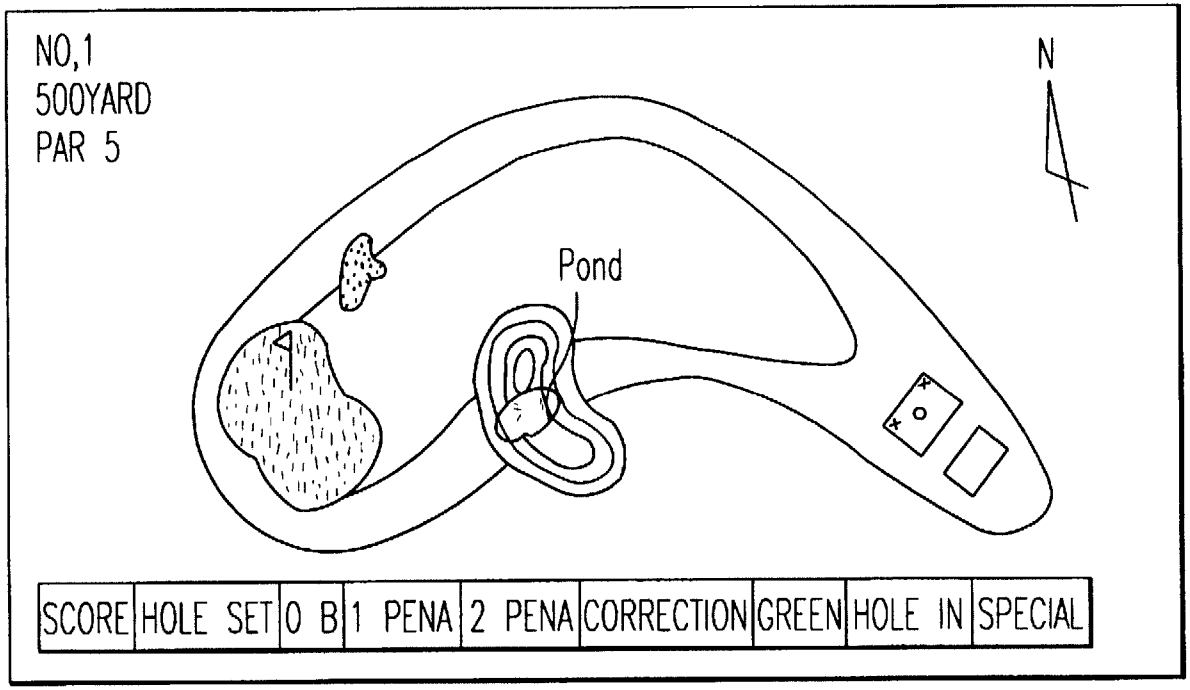
FIG. 9 is a view showing a structural example of a course layout picture plane.

FIG. 9 shows one example of the course layout picture plane.

In this picture plane, a course layout of that hole concerned is shown. An indication column is provided for items such as "Score", "Hole", "OB", "1 pena.", "2 pena.", "Correction", "Green", "Hole in" and "Special".

When the course layout has been displayed, the procedure proceeds to Step S302, where it is determined whether or not. If it is at the end, this sub-routine finishes. If not end, the procedure proceeds to Step S303.

In Step S303, a point pressed by the input pen 3 is taken into the course layout picture plane (FIG. 9).

Then, the procedure proceeds to Step S304, where it is determined whether a position is present or not. If it is position, the procedure proceeds to Step S305 as <strike> processing. If it is not position, the determination and processing for the items are carried out as an <item> processing.

In the following, <Strike processing> will be described.

In Step S305, the previous point is connected with the current point by a line. There are a case where the first point is TEE and a case where it is the first strike (in this case, they are automatically connected from TEE).

Then, the procedure proceeds to Step S306, where a residual distance is obtained by calculation from a pin flag, and the distance is displayed on the picture plane. A player can make a determination of next strike (selection of a club) with reference to the residual distance.

In Step S307, one (1) strike is added to a score count. In Step S308, it is determined where whether a green or not. If it is green, count is made as a patter and one (1) strike is added (Step S309). Step S309 is executed, and in Step S308, if it is not green, the procedure again returns to Step S302.

Next, an <item processing> will be described.

Score processing

In Step S310, it is determined whether "score". It is "score", this sub-routine is completed. The procedure proceeds to Step S201 of a sub-routine of a score data input processing. If it is not score, it is determined whether a hole set of Step S311 is or not.

Pin flag processing

Figure 26:
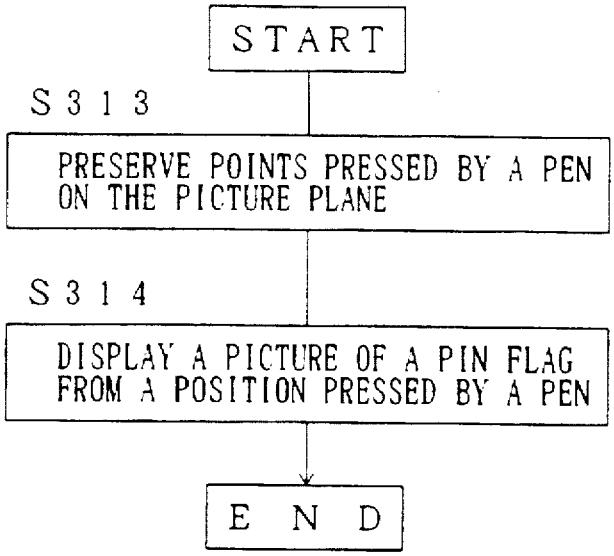
FIG. 26 is a flowchart of a pin flag setting processing.

In Step S311, if it is "hole set", a processing of a pin flag set of Step S312 is carried out. In the pin flag set processing, a point pressed by the input pen 3 on the picture plane is preserved (Step S313) as shown in FIG. 26, and a picture of a pin flag is displayed at a position pressed by the pen 3 (Step S314).

In sum, here, a picture of the pin flag is displayed at a position pressed by the pen 3 on the picture plane, and if a pin flag is already displayed, the pin flag is deleted.

OB processing

Figure 27:
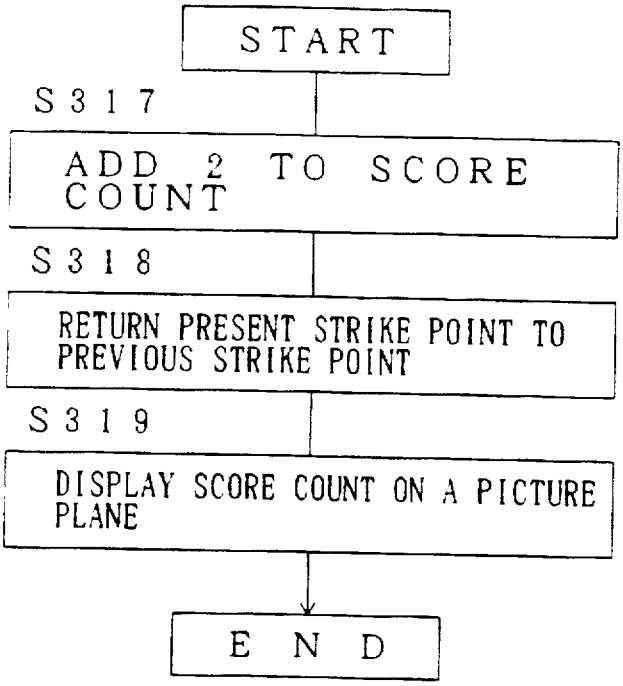
FIG. 27 is a flowchart of an OB processing.

In Step S311, when "hole set" is not present, in Step S315 it is determined whether "OB" is present or not. If it is "OB", OB processing of Step S316 is carried out. In this OB processing, as shown in FIG. 27, 2 is added to the score count in Step S317. The current strike point is returned to the previous strike point in Step S318. The score count is displayed on the picture plane in Step S319.

In sum, here, 2 strikes are added to the current score count, and the position of strike is returned to the previous place.

1 pena. processing

Figure 28:
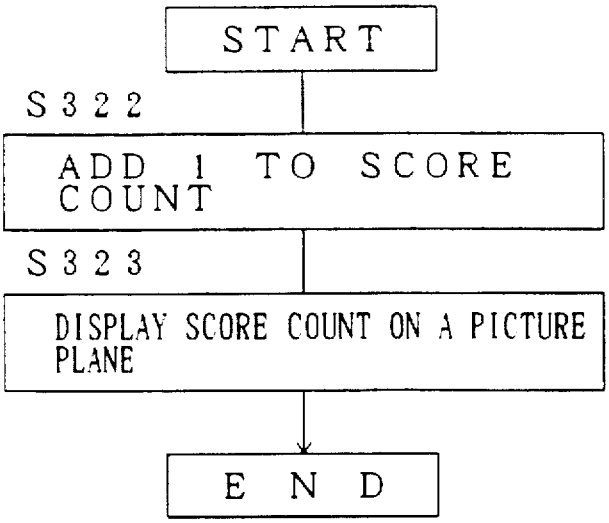
FIG. 28 is a flowchart of 1 pena. processing.

In Step S315, when "OB" is not present, the procedure proceeds to Step S320, where it is determined whether "1 pena." is present or not. If it is "1 pena.", the 1 pena. processing of Step S321 is carried out. In this 1 pena. processing, as shown in FIG. 28, 1 is added to the score count in Step S322, then score count is displayed on the picture plane in Step S323.

In sum, here, one strike is added to the current score count and taken into a place where a ball dropped.

2 pena. processing

Figure 29:
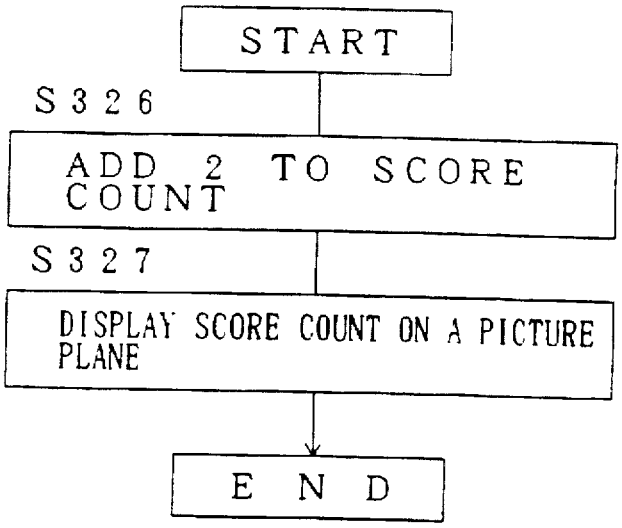
FIG. 29 is a flowchart of 2 pena. processing.

In Step S320, when "1 pena." is not present, the procedure proceeds to Step S324, where it is determined whether "2 pena." is present or not. If it is "2 pena", the 2 pena. processing in Step S325 is carried out. In the 2 pena. processing, as shown in FIG. 29, 2 is added to the score count, and the score count is displayed on the picture plane in Step S327.

In sum, here, 2 strikes are added to the current score count and taken into a place where a ball dropped.

Special tee processing

Figure 30:
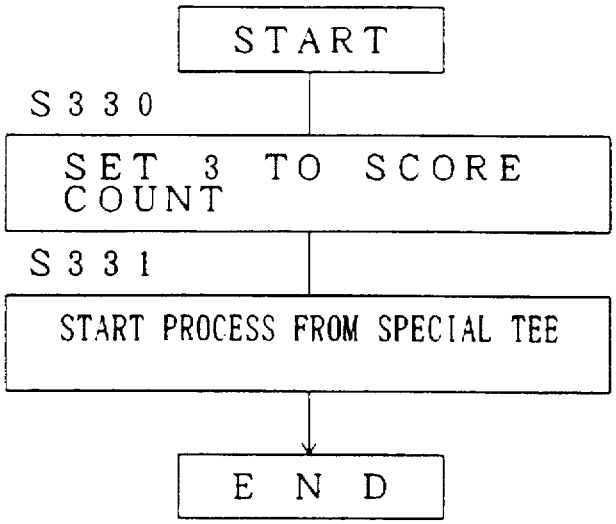
FIG. 30 is a flowchart of a special tee processing.

In Step S324, when "2 pena" is not present, the procedure proceeds to Step S328, where it is determined "special tee" is present or not. If it is "special tee", the special tee processing of Step S329 is carried out. In the special tee processing, as shown in FIG. 30, 3 is set to the score count in Step S330, and a start processing from the special tee is carried out in Step S331.

In sum, here, 3 is set to the score count and the processing from the special tee is made at the fourth strike, also the locus of the strike is started from the special tee.

Correction processing

Figure 31:
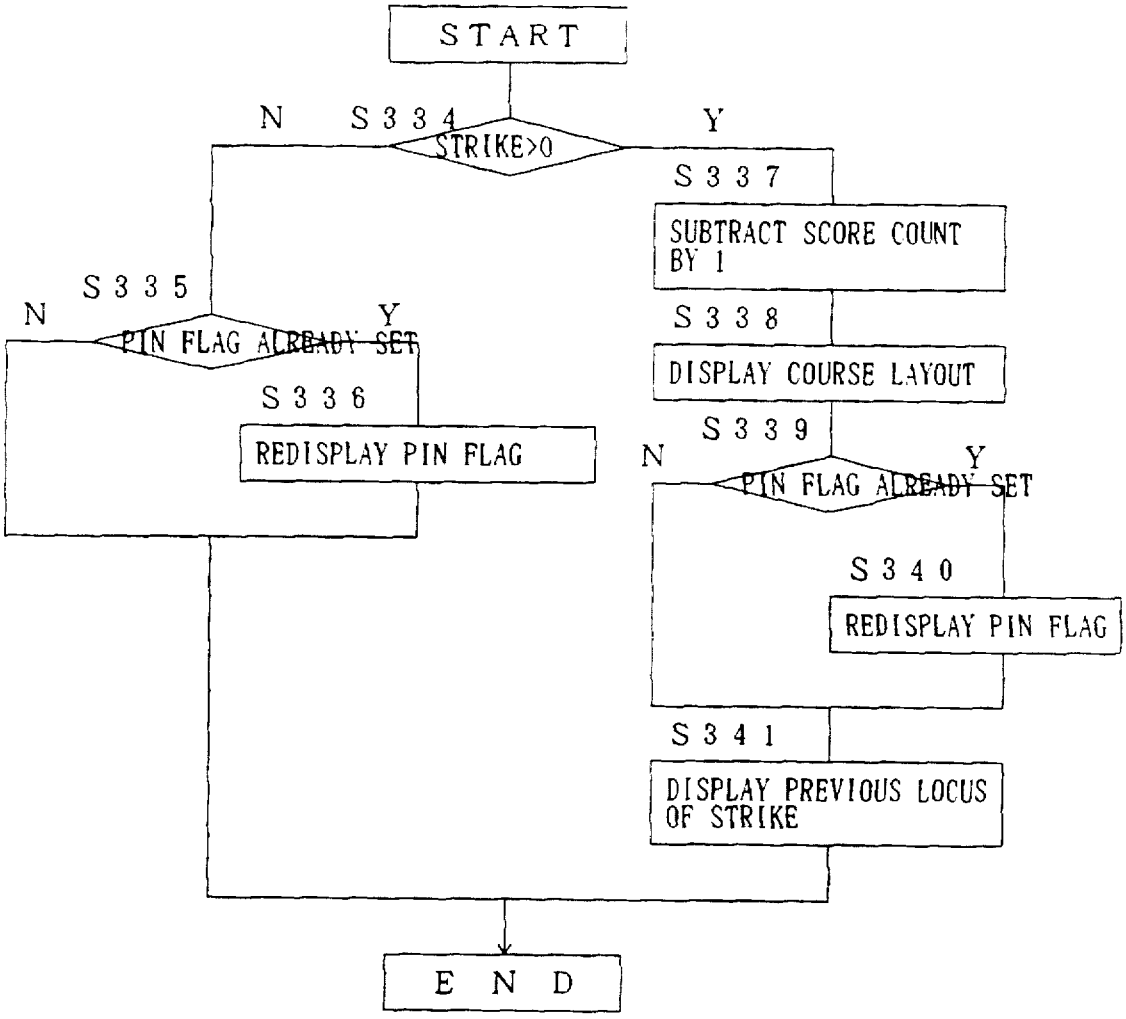
FIG. 31 is a flowchart of a correction processing.

In Step S328, when "special tee" is not present, the procedure proceeds to Step S332, where it is determined whether "correction" is present or not. If it is "correction", the correction processing of Step S333 is carried out. In the correction processing, as shown in FIG. 31, it is determined whether a strike was present or not in Step S334. When a strike was not present (strike=0) the procedure then goes to Step S335 where it is determined whether a pin flag set or not already made is. In case of YES, a pin flag is again displayed in Step S336, resulting in END. In case of NO, END directly results.

In Step S334, when a strike was present (strike>0), the procedure proceeds to Step S337, where 1 is subtracted from the score count. Next, in Step S338, a course layout is displayed, and after this in Step S339, it is determined whether a pin flag set is already made or not. If the pin flag is already set, the pin flag is again displayed in Step S340, then the procedure proceeds to next step. If the pin flag is already set, the procedure proceeds to the next step, Step S341, to display the locus of strikes previously made.

In sum, here, the locus of strikes currently displayed is deleted, and the locus of strikes previously displayed is again displayed. If the score count is counted, 1 is subtracted from the score count.

Green processing

In Step S332, when "correction" is not present, the procedure proceeds to Step S342, where it is determined "green" is present or not. If it is "green", the green picture plane display processing of Step S343 is carried out. In the green picture plane, information of a lawn of the green is displayed.

In sum, here, an enlarged picture plane of the green in which a lawn and inclinations are depicted is displayed.

Hole in processing

In Step S342, when "green" is not present, the procedure proceeds to Step S344, where it is determined whether "hole in" is present or not. If it is "hole in", the procedure ends. Then the sub-routine of the course layout is completed, and the procedure returns to Step S201. If it is not "hole in", the procedure again returns to Step S302.

(Individual evaluation)

The procedure again returns to the main processing (FIGS. 16 and 17).

When an "individual evaluation" of "5" on the menu picture plane (FIG. 4) is instructed by the input pen 3, the procedure shifts to Step S26, then a sub-routine of the individual evaluation processing in Step S27 is executed.

Figure 32:
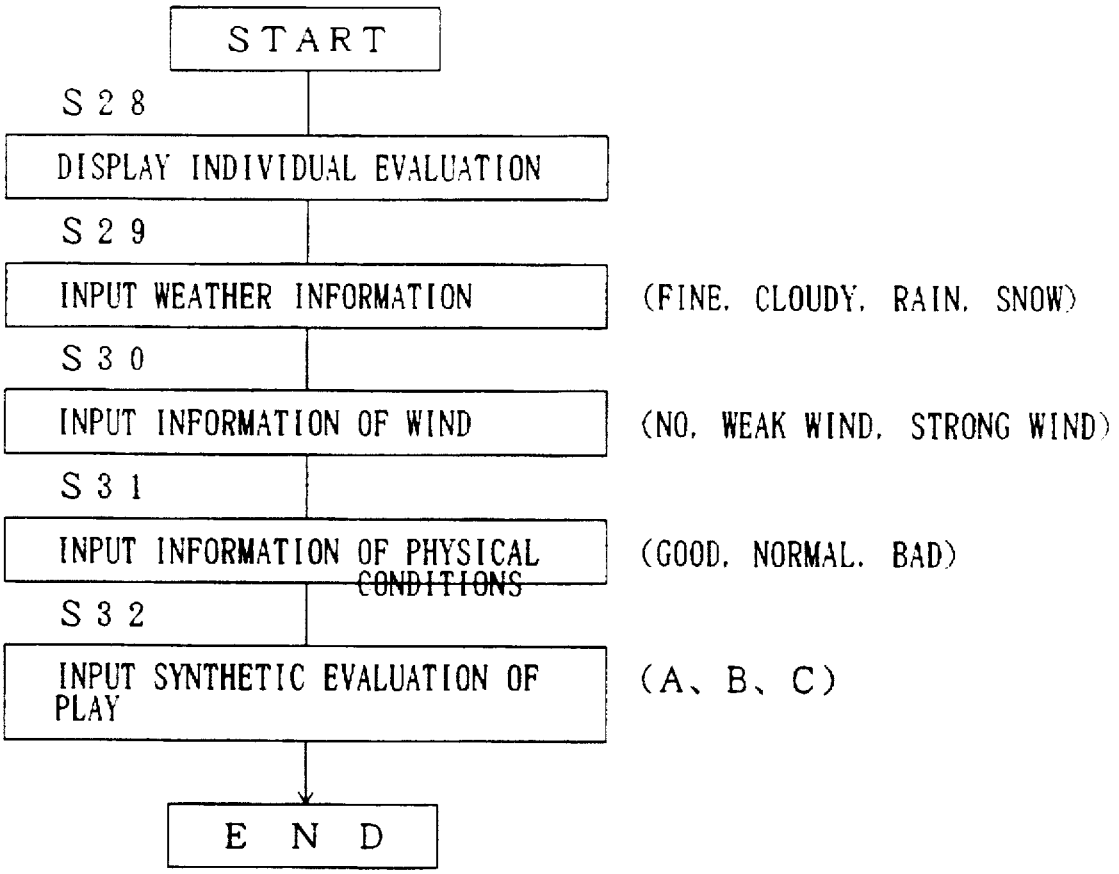
FIG. 32 is a flowchart of an individual evaluation processing.

FIG. 32 shows a flowchart of a sub-routine of the individual evaluation processing. In Step S28, an individual evaluation picture plane is displayed.

FIG. 11 shows a display example of the individual evaluation picture plane. On the picture plane, a date of play is automatically displayed.

In the individual evaluation picture plane, the following procedure is executed by the instruction of the input pen 3. That is, in Step S29, weather information is inputted. In Step S30, information of wind is inputted. In Step S31, information of physical condition is inputted. In Step S32, the synthetic evaluation of the play situation is inputted.

(ATTESTED BY processing)

When "ATTESTED BY" of "6" in the menu picture plane (FIG. 4) is instructed by the input pen 3, the procedure proceeds to Step S33, then a sub-routine of ATTESTED BY processing of Step S34 is executed.

Figure 33:
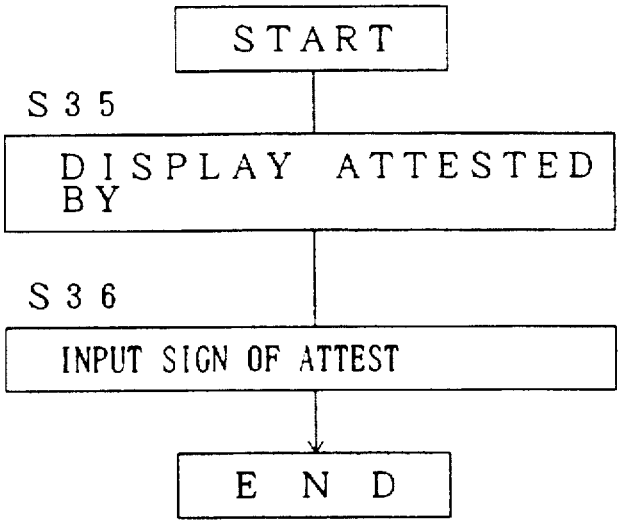
FIG. 33 is a flowchart of an ATTESTED BY processing.

FIG. 33 is a flowchart of a sub-routine of the ATTESTED BY processing. In Step S35, an ATTESTED BY picture plane is displayed.

Figure 12:
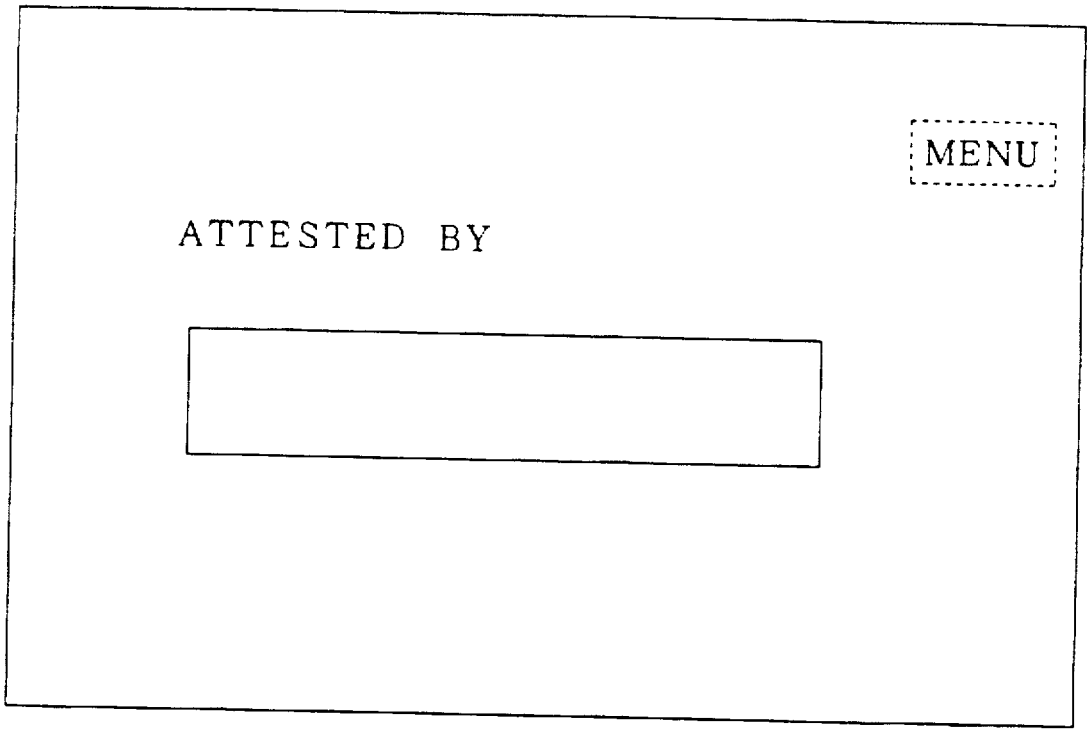
FIG. 12 is a view showing a structural example of an ATTESTED BY picture plane.

FIG. 12 shows one example of the ATTESTED BY picture plane. Next, in Step S36, in this picture plane, a signature of a player is inputted using the input pen 3 for ATTEST.

(Score card printing processing)

When "Score card printing processing" of "7" in the menu picture plane (FIG. 4) is instructed by the input pen 3, the procedure shifts to Step S37, then a sub-routine of the score card printing processing of Step S38 is executed.

Figure 34:
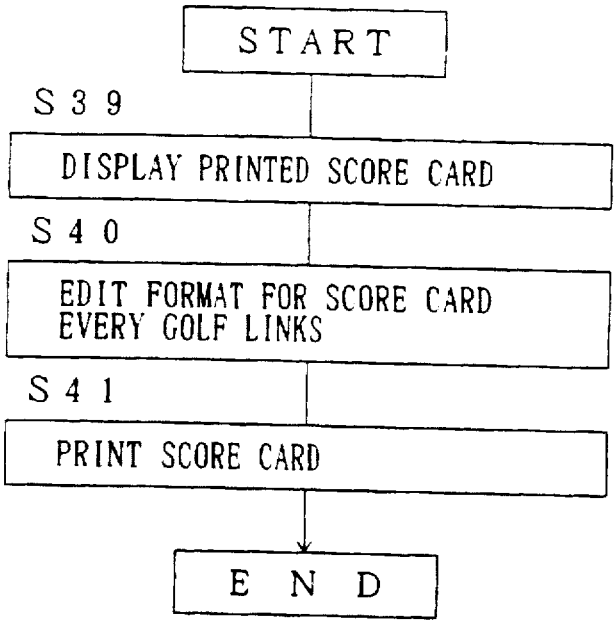
FIG. 34 is a flowchart of a score card printing processing.

FIG. 34 is a flowchart of a sub-routine of the score card printing processing. In Step S39, a printing picture plane of the score card is displayed.

FIG. 13 shows one example of a display of the printing picture plane.

Next, in Step S40, a format for a score card of each golf links is edited, and the score card is printed out in accordance with the format in Step S41.

(File write processing)

When "File write" of "8" in the menu picture plane (FIG. 4) is instructed by the input pen 3, the procedure proceeds to Step S42, then a sub-routine of the file write processing of Step S43 is executed.

Figure 35:
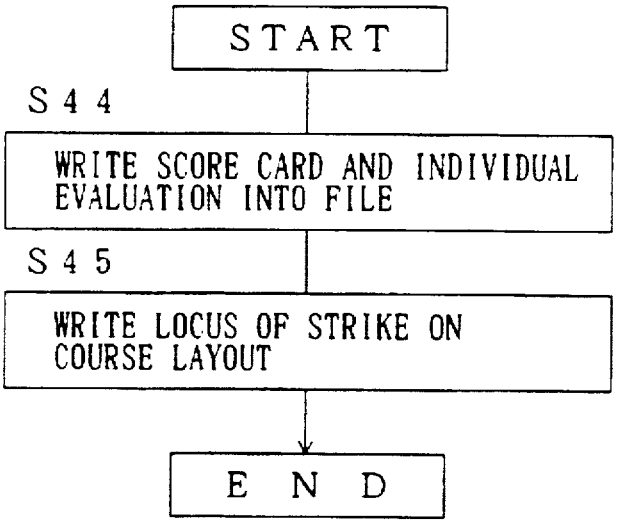
FIG. 35 is a flowchart of a file write processing.

FIG. 35 is a flowchart of a sub-routine of the file write processing.

In Step S44, a score card and an individual evaluation are written into a file, then, in Step S45, the locus of strikes on the course layout is written into a file.

(End processing)

When "End" of "9" in the menu picture plane (FIG. 4) is instructed by the input pen 3, the procedure shifts to Step S46, then an end processing is done.

Players individually carry the display 1 while play is proceeding on the basis of the electronic golf score display device.

After completion of a play, when an output is instructed from display 1, information is transferred to a host computer in the head office for data to be added up and displayed.

(Effects of the embodiments)

As described above, according to the electronic golf score display device of the present embodiment, the display 1 as the body thereof is small in type, which can be easily hand carried. The display picture plane receives an input operation by the input pen 3, which is easy in operation and possible in quick response, thereby realizing a device which is convenient in operation in the field.

By instruction of an item in the menu picture plane a quick picture plane development is realized. As a score picture plane, a course layout picture plane and a total score picture plane are operatively connected, by being inputted as various play states into the course layout picture plane, as current scores are automatically counted and displayed, so that current scores can be presented at any time and accurately.

In the course layout picture plane, various play states are provided, which are only instructed by the input operation of the input pen 3, so as to be convenient.

In the course layout picture plane, the locus of strikes is displayed immediately by only a touching operation of the input pen, and at the same time the residual distance is displayed. Therefore, any player can properly judge the residual distance. As a result, it is possible to omit a difficult work of indicating the residual distance.

By the use of the IC card 2, the capacity of the memory 13 in the body can be reduced, and information of golf links and the course layout and the score card are recorded in the IC card 2 to enable a multiuse utilization including the exclusive use for the particular golf links and other golf links.

The summing up after completion of play is also managed by a computer so that it is conveniently displayed accurately and quickly and in the form as desired.

The present invention is not limited to the above-described embodiments but various changes in design can be made within the scope of the fundamental technical idea of the present invention. Namely, the following modes are contained in the technical scope of the present invention.

(1) In the whole structure of the present system, the keyboard 11 as the input device can be omitted, and by only the input pen 3 can be possible. Further, the touch input function can be added to the input/output picture plane.

In addition, the IC card 2 can be omitted. In this case, all the predetermined information is stored in the memory 13 within the display 1.

(2) The processing procedure can take the following modes.

(2-1) The menu processing picture plane can be omitted. During the play, at least the score card setting picture plane and score card picture plane processings and the course layout picture plane processing are executed, and after completion of play, at least the score card printing processing is executed.

More specifically, the file reading processing is carried out before or during play. However, the local rule confirmation can be omitted. After completion of play, the individual evaluation processing and the ATTESTED BY processing are omitted, and the file write processing is suitably executed.

(2-2) When no input is present for a predetermined time of period, the picture plane disappears while holding the information.

(2-3) The procedure for the input instruction to the input/output picture plane in the score card setting processing shown in FIG. 19 and the individual evaluation processing shown in FIG. 32 is not always inputted as in the flowcharts but any item can be inputted first.

What is claimed is:

1. An electronic golf score display device comprising:

a display unit having a display plane and displaying a required picture plane, said display unit further including at least one of an input pen and a key pad for inputting data information from a user;

a memory means for storing predetermined processing procedures and for storing data information input by said user; and a processing device interposed between said display unit and said memory means wherein said processing device processes said data information in accordance with said processing procedures stored in said memory means, wherein said processing device includes:

a first means for displaying a score card setting picture plane on said display plane by inputting necessary score conditions from a selection of at least one of a course, a yardage, and a player's name wherein said first means inputs said input information into said memory according to said score card setting picture plane;

a second means for displaying input information of said score card setting picture plane providing for an indication for each hole on said display plane;

third means for automatically calculating a score by inputting each striking of a golf ball and inputting each score into said memory;

fourth means for displaying a golf course layout picture plan of a hole designated on said display plane and displaying a line of a locus of said strokes from a previous point to a new point input by said input pen through said golf course layout picture plane on said display plane and inputting a score of said hole into said memory by inputting said new point; and fifth means for displaying said score through said score card picture plane on said display plane at an end of the displaying of said golf course layout picture plane on said display plane.

2. An electronic golf course display device according to claim 1, wherein said processing device processes said data information for displaying a golf course layout includes information for determining a distance from a hole being played on the golf course after each stroke by said user.

3. An electronic golf course display device according to claim 2 wherein said data information for displaying a golf course layout includes information for updating said user's score after each stroke.

4. A method for displaying a golf score using an electronic golf score display device having a display unit with a display plane which displays a required picture plane on said display plane and having at least one of an input pen and key pad for inputting data information to said display plane, said display device further including a memory for storing said input data information by said user and for storing predetermined processing procedures, and said device further including a processing device positioned between said display unit and said memory to process said data information in accordance with said processing procedures stored in said memory, said method comprising the steps of:

displaying a score card picture on the display plane;

displaying a course layout picture of the hole on the display plane by instructing a hole of the score card picture;

inputting a position of a stroke and displaying a line of a locus of strokes on the course layout picture by use of said at least one of said input pen and said key pad on the course layout picture by said user;

calculating a score due to said stroke; and displaying the score card picture as updated by instructing the score card picture from the course layout picture.

* * * * *